US005485933A

United States Patent [19]

Crooymans

[11] Patent Number: 5,485,933

[45] Date of Patent: Jan. 23, 1996

[54] SHELVING SUPPORT SYSTEM

[76] Inventor: Rene W. Crooymans, 249 Belgrave-Gembrook Road, Clematis Victoria, Australia

[21] Appl. No.: 162,206

[22] PCT Filed: Jul. 21, 1993

[86] PCT No.: PCT/AU93/00363

§ 371 Date: Dec. 8, 1993

§ 102(e) Date: Dec. 8, 1993

[87] PCT Pub. No.: WO94/02050

PCT Pub. Date: Feb. 3, 1994

[30] Foreign Application Priority Data

Jul. 22, 1992 [AU] Australia ..... PL3648/92

[51] Int. Cl.[6] ..... A47F 5/08

[52] U.S. Cl. ..... 211/90; 211/94; 211/153; 211/87

[58] Field of Search ..... 211/90, 94, 88, 211/153, 87

[56] References Cited

U.S. PATENT DOCUMENTS

| | | | |
|---|---|---|---|
| 4,752,010 | 6/1988 | Holztrager | 211/90 |
| 4,821,892 | 4/1989 | Randall | 211/90 |
| 5,148,925 | 9/1992 | Althoff et al. | 211/94 X |
| 5,228,579 | 7/1993 | Kaufman | 211/94 |

FOREIGN PATENT DOCUMENTS

| | | |
|---|---|---|
| 100188 | 4/1988 | Australia . |
| 108094 | 7/1990 | Australia . |
| 33082/89 | 10/1990 | Australia . |
| 129520 | 12/1928 | Switzerland . |
| 1222488 | 2/1969 | United Kingdom . |

*Primary Examiner*—Leslie A. Braun

*Assistant Examiner*—Gwendolyn Wrenn

*Attorney, Agent, or Firm*—Merchant, Gould, Smith, Edell, Welter & Schmidt

[57] ABSTRACT

A shelving support system is disclosed (FIG. 3 ) comprising a series of spaced vertical columnar supports 300 of steel channel having a series of cutouts 320 formed at regularly-spaced intervals in the flanges 308 thereof. Each cutout 320 defines an upper lip 323, a lower lip 235 and a rear horizontal shoulder 342. Linear extrusions 324*a* and 324*b* of suitable aluminium or plastics material which define shelf-slots 326 are fitted into cutouts 320 so as to be horizontally located between the backs of upper and lower lips 323 and 325 and the rear periphery 344, and, so as to be located vertically by the underside of a shoulder 342 formed on flange 308 at the rear of the cutout and a land 362 and/or the top of the lower lip 325 at or near the lower front of the cutout.

Each extrusion 324 includes a curved, forwardly-facing, hook-like thumb-strip formed along its upper wall which hooks behind upper lip 323 when the extrusion is in place within the cutout 320. The extrusion 324 being fitted in place by tilting it down and to the rear until thumb-strip 326 passes under lip 323 and then swinging the front of extrusion 324 down to bring its back wall 334 into contact with rear face 344 of cutout 320.

An upwardly facing panel-slot 346 and a downwardly facing panel-slot 348 are respectively formed on the upper front face and the lower front face of extrusion 320, the depth of upper slot 346 being greater than that of lower slot 348. An appropriately cut finishing-panel 364 can be inserted in place between adjacent extrusions 324*a* and 324*b* by first entering its upper edge into lower slot 348 of upper extrusion 324*a* until the top of slot 346 is reached, aligning its lower edge with the upper slot 346 of lower extrusion 324*b* and then allowing the panel to drop into that slot.

7 Claims, 4 Drawing Sheets

SHELVING SUPPORT SYSTEM

TECHNICAL FIELD

This invention relates to support systems for shelves, brackets and the like suitable for the lateral display and storage of goods in shops, libraries and storage areas. More particularly, the invention relates to support systems of the type having vertical columnar supports fixed at regular intervals to a wall (or other fixture) and having means for attaching a series of horizontally arranged shelves, brackets and/or hangers to the supports.

Though not confined thereto, the support systems of this invention are particularly suited for shelf-based display of goods in shops.

BACKGROUND TO THE INVENTION

Ideally, display shelving for shops should be readily and cheaply adjustable and yet provide an attractive finish. This combination is difficult to achieve. It is well known, for example, to use slotted columnar supports with snap-in shelf-support brackets to provide cheap and rapid adjustment of shelf height or position. A variety of hooks and hangers can be used with such slotted supports. But the supports and brackets are unsightly. Panelling can be used between the shelves to cover the supports and the wall, but this immediately removes the advantage of adjustability .and leaves the unsightly shelf-support brackets uncovered.

It is also known to use attractively finished wall-panels having a series of fixed, vertically-spaced, horizontal-extending T-slots into which shelf-support and other brackets may be fitted. A system of this type, marketed as SHOW-ALL®, is produced by Display Systems Inc of Chilhowie, Va., USA. However, as the slotted panels are costly, the unused slots are unsightly, and vertical adjustability is limited because the number of slots in a panel must be limited to keep panel costs within reason. Moreover, unsightly braced brackets are still required to support shelving.

OBJECTIVES OF THE INVENTION

It is the broad objective of the invention to provide an improved shelving system of the general type indicated above. Preferably, the shelving system should do away with the need for shelf support brackets, provide adequate flexibility in the adjustment of shelf height, and, provide means for attractively panelling the spaces between the shelves while still allowing subsequent shelf adjustment without difficulty or great cost. However, it is not necessary for all these desiderata to be satisfied by every embodiment of the invention.

OUTLINE OF INVENTION

In the shelving support system of this invention: each columnar support includes at least one longitudinal flange having a front edge; cutouts are formed in the flange at regular intervals along its length so that each cutout extends rearwards from an opening in the front edge, the opening being shaped so as to form a downwardly-extending upper-lip of flange material; shelf support means comprising linear extrusions of metal or plastics material are provided for engagement with the cutouts, each extrusion having integral upper, rear and lower walls defining (in section) a forwardly-opening shelf-slot adapted to receive the rear edge of a shelf to be supported thereby; and an upwardly extending thumb-strip is formed integrally with the upper wall of the shelf-slot; whereby, the extrusion may be held orthogonal to the web and inserted rearwardly into a cutout by first tilting the extrusion back and up to allow the thumb-strip to pass behind the upper-lip and then tilting the extrusion down and forwards until the thumb-strip contacts the upper-lip and the lower and/or rear walls of the extrusion make contact with the periphery of the cutout.

Conveniently, the columnar support may be formed from a folded or rolled steel member of 'L', 'U' or inverted-'T' section. Other sections such as 'I' or 'W' are also envisaged. In the case of an 'L' section or angle member, one leg (the back) is adapted to be secured to the wall or other fixture while the other leg forms the aforementioned flange; in the case of a 'U' or channel section the base (or back) is adapted to be secured to the fixture and each leg forms a flange; and, in the case of a 'T' section, the leg forms the flange and the head is forms the back.

Preferably, the thumb-strip is located near the forward end of the upper wall of the shelf-slot and is curved (in section) so as to form a hook with a forwardly facing concavity adapted to engage with and rotate about the upper-lip as the extrusion is entered into the cutout.

The cutout may also be shaped to define a lower-lip and a corresponding forward-facing abutment may be formed on or by the lower wall of the shelf-slot. This prevents the extrusion from being removed from a cutout without first raising the abutment clear of the lower-lip, by (for example) flexing the extrusion to narrow the shelf-slot, raising the extrusion bodily within the cutout and/or by tilting the extrusion within the cutout. It is also preferable to shape the cutout to form a horizontal shoulder near the rear thereof so that the rear of the upper wall can bear upwardly against the shoulder. The forward portion of the lower wall of the shelf-slot may be raised to extend forwards over the lower lip to form a land on which the lower face of a shelf may rest (when fitted within the shelf-slot).

An upwardly-facing panel-slot may be formed by the extrusion to up-stand from the front of the upper wall of the shelf-slot. A similar downwardly-facing panel-slot may be formed by the extrusion at the front of the lower wall of the shelf-slot. These panel-slots are adapted to carry panels which cover the columnar supports and the space between adjacent extrusions. The panels (preferably pre-finished) are of simple rectangular shape, can be of cheap but attractive material and are easy to cut and fit. They can be readily fitted and replaced between two adjacent extrusions if, as preferred, the depth of the lower panel slot is less than that of the upper (in the vertical direction) so that the panel can be entered into the lower slot of an upper extrusion and then dropped into the upper slot of the adjacent lower extrusion (and removed in reverse fashion).

DESCRIPTION OF EXAMPLES

Having broadly portrayed the nature of the present invention, examples will now be described by way of illustration. In the following description, reference will be made to the accompanying drawings in which.

Figure 1:
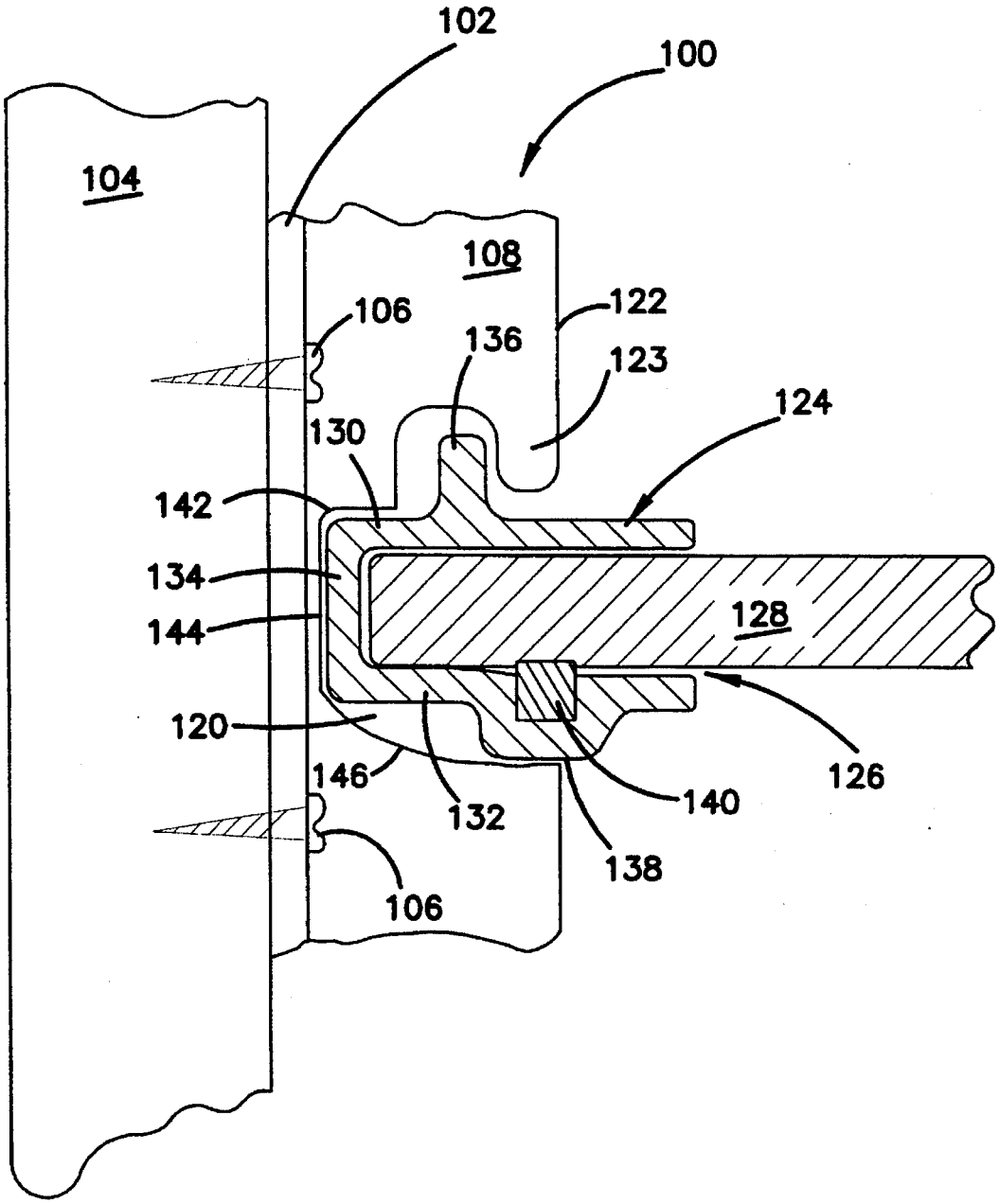
FIG. 1 is a diagrammatic end elevation of a columnar support with a simple extrusion (shown in section) fitted into a cutout in the flange and a shelf fitted into the extrusion, the support and extrusion comprising the first example of the invention.

In the first example (FIG. 1), a rolled or folded steel angle 100 forms the aforementioned columnar support and is secured by its back flange 102 to a timber wall-stud 104 by screws 106. The front flange 108 of angle 100 has a cutout 120 opening into its front face 122 and defining a downwardly-extending upper-lip 123. As illustrated, an extrusion 124 (preferably of aluminium) is engaged within cutout 120, the extrusion being formed so as to define a rectilinear shelf-slot 126 within which a shelf 128 (of glass, for example) can be fitted.

The shelf-slot 126 is defined by parallel upper and lower walls 130 and 132 and by rear wall 134, upper wall 130 having an integral thumb-strip 136 upstanding therefrom and lower wall 132 having an ridge 138 formed on the under surface thereof. Ridge 138 is formed so as to define a groove-like depression in the inner face of wall 132 within which a hard-rubber pad-strip 140 is housed to cushion and retain shelf 128 in slot 126. The cutout is formed so as to define an upper rear shoulder 142 against which the rear of upper wall 130 can bear.

Extrusion 124 is fitted into cutout 120 simply by offering it up horizontally to the opening of cutout 120, tilting its front face upwards until thumb-strip 136 passes under lip 123 and then swinging its front face down until ridge 138 contacts the forward part of the lower edge of cutout 120. In this example, the weight of shelf 128 (once inserted into shelf-slot 126) is borne, principally, by contact between ridge 138 and the lower-front periphery of cutout 120 and by contact between the rear of upper-wall 130 and shoulder 142. Some force, may also be borne by contact between thumb-strip 136 and lip 123 and by contact between rear-wall 134 and the back 144 of cutout 120. The lower rear periphery of cutout 120 is of arcuate form (shown at 146) to allow extrusion 124 to be swung into place while pivoting around lip 123 (and allow it to be removed in similar manner).

In the second example (FIG. 2), the columnar support is formed by a folded or rolled steel channel 200 secured by its back 202 (shown in section) to a fixture 204 by screws 206. Each flange 208 has a series of cutouts 220 opening into its front face 222, each cutout defining a downwardly extending upper lip 223 and an upwardly extending lower lip 225. While each extrusion (224*a*, 224*b* and 224*c*) shown in this example is more complex than that of the first example, it also defines a forwardly-opening shelf-slot 226 having upper wall 230, lower wall 232 and rear wall 234. Upper wall 230 also carries a thumb-strip 236 but, in this example, the thumb-strip is formed (in section) as a semi-circular forward-facing hook. A groove is also formed in the upper face of lower wall 232 to carry a rubber cushion strip 240 but, in this example, the groove is of key-hole shape so as to retain the mushroom-shape strip 240. A downwardly facing groove 241 is formed along the under-side of the forward edge of upper wall 230 to house a sealing or finishing rubber strip (not shown) which bears against the upper face of a shelf (not shown) fitted in slot 226. Finally, the under-side of lower wall 232 carries a downwardly facing abutment-strip 245 positioned so as to define a downwardly-facing slot 247 of sufficient width and depth to accommodate lower lip 225.

In this example, an upper panel slot 246 is formed along the upper-side of the forward edge of upper wall 230 to take the lower edge of a cover-panel (not shown). A lower panel-slot 248 is formed along the lower-side of the forward edge of lower wall 232 to take the upper edge of a cover-panel (not shown). The depth of lower slot 248 is greater than that of upper slot 246 so that a panel can be readily fitted and removed between two adjacent extrusions (as will be described in the third example).

The three extrusions 224*a*, 224*b* and 224*c* of the second example are shown in successive stages of being fitted into their respective cutouts 220. In the first stage, extrusion 224*a* is tilted so that thumb-strip 236 passes under and hooks around upper lip 223 and extrusion 224*a* is then swung downwardly and rearwardly about lip 223 (as shown by arrow 250). In the second stage, extrusion 224*b* is swung down and rearward until its rear wall 234 contact rear wall 244 of cutout 220, the extrusion having been held up so that abutment-strip 245 clears lower lip 225 (as shown in the drawing). In the third stage, extrusion 224*c* is allowed to drop downwards (as indicated by arrow 252) until it rests on the lower edge of cutout 220 and abutment-strip 245 is lodged behind lower-lip 225.

Figure 2:
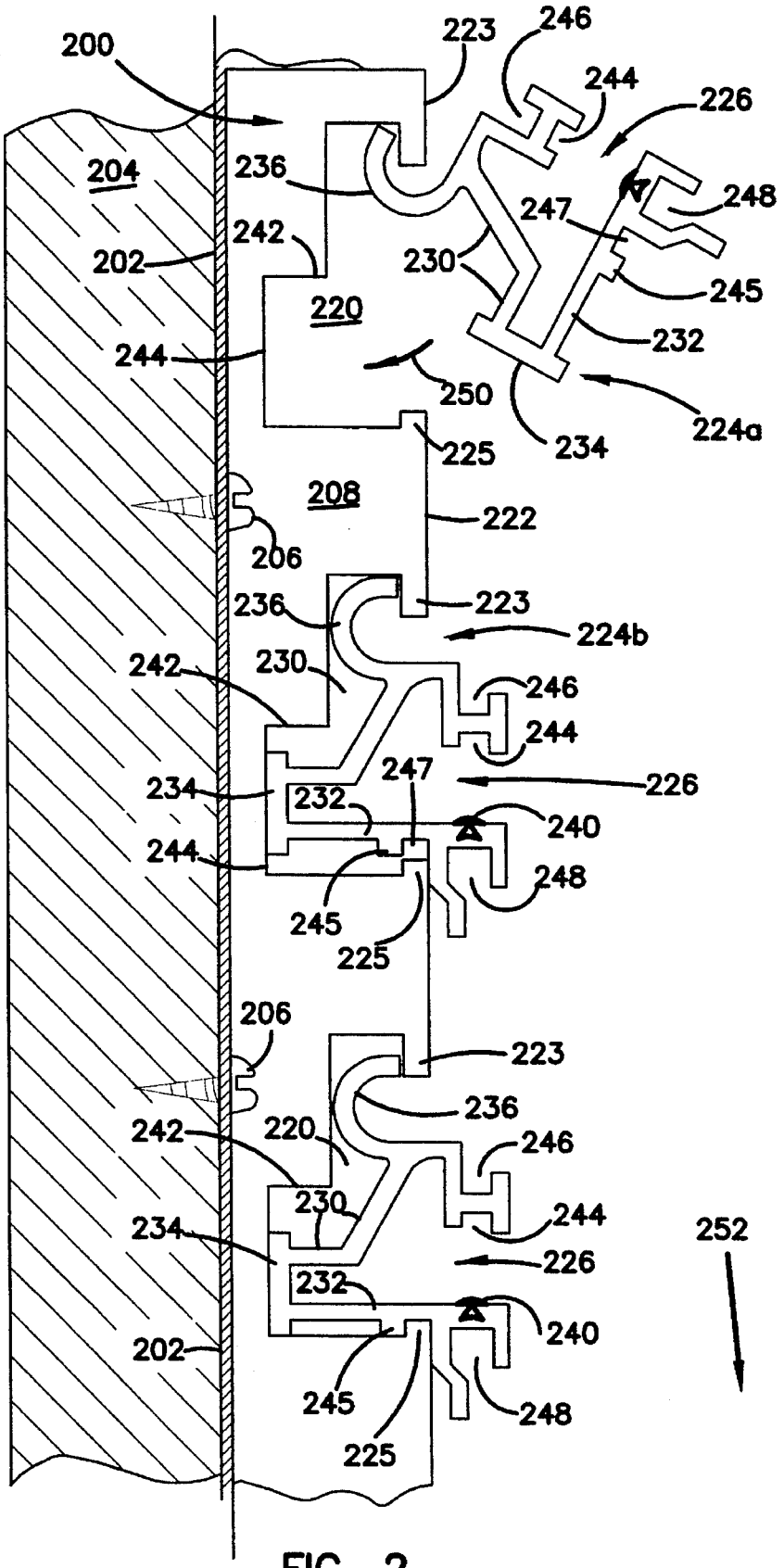
FIG. 2 is a similar view to that of FIG. 1 illustrating a second example of the invention and showing the sequence of steps involved in fitting the extrusion into the cutout.
Figure 2A:
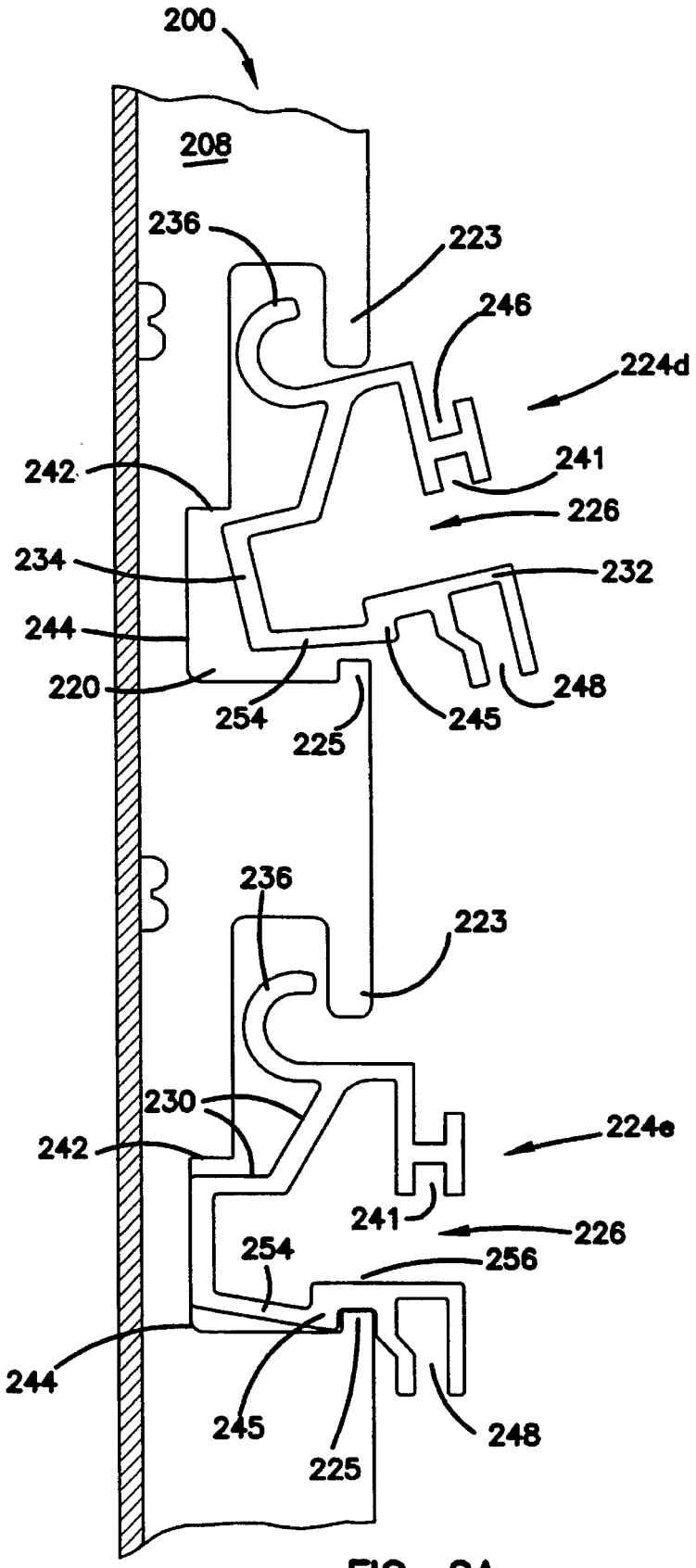
FIG. 2A is a similar view to that of FIG. 1 and illustrates a modified form of the second example.

Since the upper wall 230 of shelf-slot 226 defined by extrusion 224*c* is not supported by shoulder 242 of the cutout, the maximum shelf-loading will be low. Modifications to the extrusion and cutout of the second example (FIG. 2A) can be made to provide better support for the shelf. In FIG. 2A the same reference numerals are used to identify the same parts as in FIG. 2 and two extrusions 224*d* and 224*e* are shown in two stages of entry into cutouts 220. The essential difference between these extrusions and those of FIG. 2 is that the rear part 254 of lower wall 232 is angled downwardly and forwardly so that it is integrated with abutment strip 245 and so that its lower surface forms a wedge or ramp with respect to the upper wall. This results in the formation of a raised land-strip over the lower lip 225 upon which the under-face of a shelf may rest. The cutout of the modified second example, is essentially the same as that of FIG. 2 except that shoulder 242 is lowered so as to provide support for the rear of upper wall 230 of shelf-slot 226 (as shown with the position of extrusion 224*e*).

The modified extrusion of FIG. 2 is entered into the cutout 220 and swung down as before but, in this case the under-face of rear portion 254 of lower wall 232 will contact the top of lower lip 225. To clear lip 225 extrusion 224*d* will have to be flexed (as indicated by broken lines) to narrow the opening of shelf-slot 226. Once in place, with rear wall 234 abutting the rear face 244 of cutout 220 and with the upper rear of upper wall 230 tucked under (and in contact with) shoulder 242, the lower wall 232 can be released so that abutment 245 snaps into place behind lip 225.

Preferably, (i) the vertical distance between land 256 and the lower extremity of groove 244 (which defines the upper edge of shelf-slot 226) is substantially greater than the thickness of the shelf to be accommodated, (ii) the vertical distance between the level of land 256 and the level of the under-side of the rear portion of upper wall 230 approximates the shelf thickness and, (iii), the distance between most of the rear portion 254 of lower wall 232 and the level of the rear of upper wall 230 is substantially greater than the thickness of the shelf. This allows the shelf to be easily entered into the shelf-slot 226 by tilting the front of the shelf up so that the rear edge thereof passes easily under the rear portion of the upper wall 230. The shelf is then pushed home as it is lowered to the horizontal, the shelf weight being borne principally by the rear of upper wall 230 which is supported by shoulder 242 of the cutout and by land 256 which is supported by lower lip 225 and/or the region of the cutout to its immediate rear.

The extrusion 324 employed in the third example (FIG. 3) is very similar to that of FIG. 2A except that the abutment 345 on the under-face of lower wall 332 is arranged to slope upwardly and forwardly (the rear face of the lower lip 325 being correspondingly sloped). A land-strip 356 is formed over lower lip 325 and performs the same function as described with respect to land 256 in FIG. 2A. While the rear portion 354 of lower wall 332 is formed parallel with upper wall 330, it may also be sloped as in the extrusions of FIG. 2A. The cutout 320 is essentially the same as that of FIG. 2A except that the lower rear edge 360 is sloped downwardly and rearwardly from a substantially horizontal flat 362 formed immediately behind lower lip 325. This combination of modifications with respect to the example of FIG. 2A allows extrusion 324 to be swung downwardly into cutout 320 and fitted into place without having to spring or flex the extrusion and, yet, the combination of the shapes of the extrusion and cutout is such that the rear of upper wall 330 can be firmly supported by shoulder 342 of flange 308 of the channel-section columnar support 300 (shown in perspective in FIG. 3).

Figure 3:
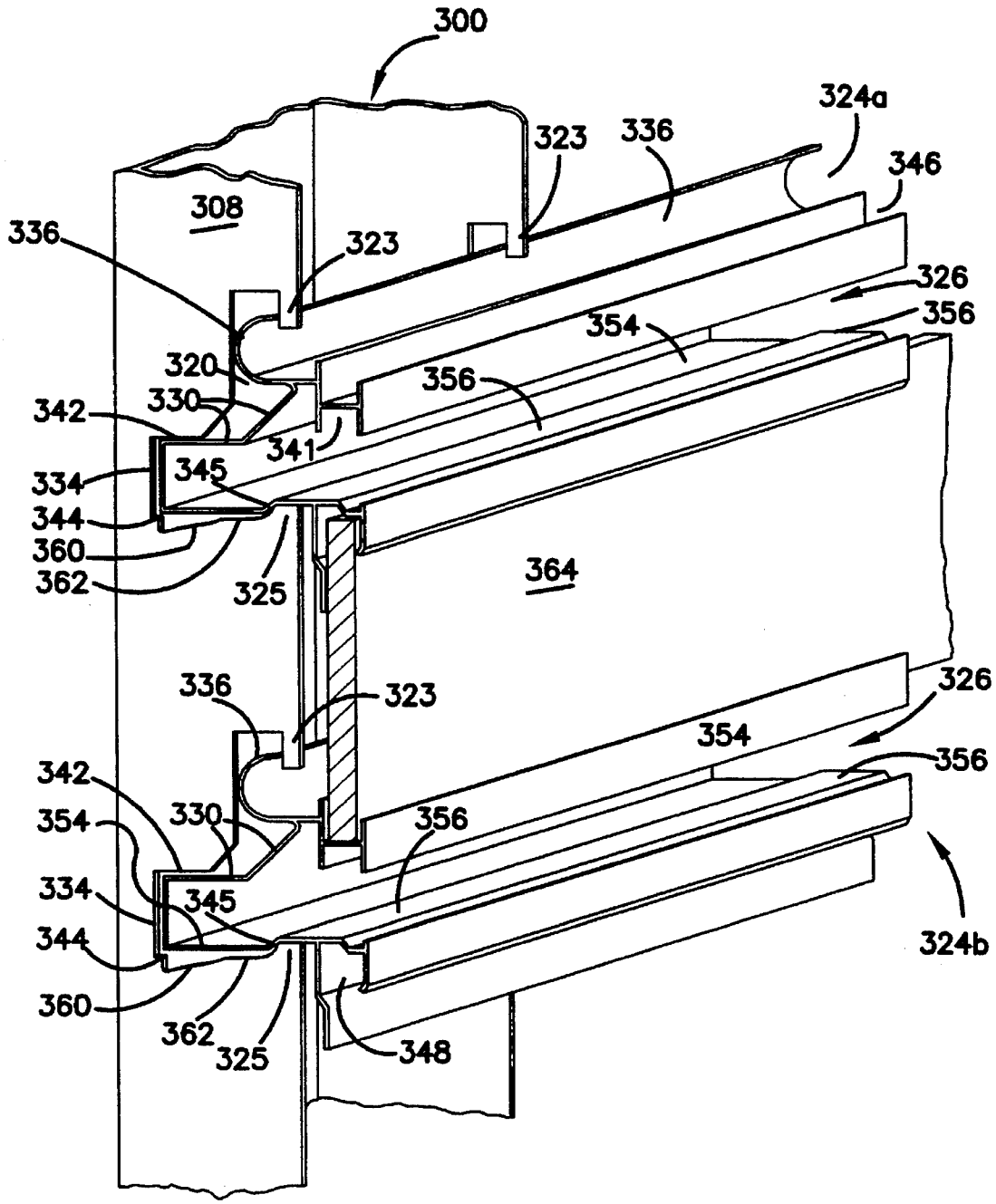
FIG. 3 is a perspective view of the third example showing a panel in place between two adjacent extrusions.

Like the example of FIG. 2A, that of FIG. 3 differs from the examples of FIGS. 1 and 2 in regard to the fitting and accommodation of the shelf (not shown in FIG. 3). In these earlier examples, all or part of the upper and lower shelf-slot walls were parallel and were spaced apart by a distance just sufficient to accommodate the thickness of the shelves employed. With the third example, both the height of the front opening (ie, the vertical distance between the lower face of groove 341 and land 356) and the height of the rear shelf-slot (ie, the vertical distance between the rear portion of upper wall 320 and the rear portion 354 of the lower wall) can be considerably greater than the thickness of the shelf to be accommodated. This allows easy entry of the shelf into its slot 326. It is important for the proper location and support of the shelf, however, that the vertical distance between the level of land 356 and the level of the rear of upper wall 320 approximates the shelf thickness. Thin double-sided adhesive tape may be used between the shelf and either point (or both points) of contact with the extrusion to hold the shelf into the shelf-slot. If the tape is applied between the shelf and land 356, it can usefully substitute for a cushion-strip (such as 140 or 240 in FIGS. 1 or 2 respectively). As in the case of the example of FIG. 2A, the weight of the shelf is mostly transferred to the flange 308 via shoulder 342 and the top of lip 325 and/or the flat 362.

The extrusion 324 of FIG. 3 is provided with upper and lower panel slots 346 and 348 which are essentially the same as panel-slots 246 and 248 of FIG. 2. In FIG. 3, however, a panel 364 is shown fitted in place. As previously noted, panel 364 is simply installed by holding it up to the extrusions and slipping the upper edge into the lower panel-slot 348 of upper extrusion 324*a*, raising the panel until it abuts the top of slot 348, swinging the lower edge of panel 364 until it is vertically above and in-line with upper slot 346 of lower extrusion 324*b*, and then dropping the panel into slot 346 so that it rests on the bottom of this slot. If panel 364 is cut appropriately, it will not drop out of slot 348 of extrusion 324*a* since the depth of that slot is greater than that of slot 346 of extrusion 324*b*.

It will be appreciated that the examples of the invention described above meet one or more of the desiderata set out as objects of the invention. However, those skilled in the art will also understand that many variations and modifications can be made to the invention as disclosed without departing from its spirit or scope as defined by the following claims. For example, the cutouts can be made in the flanges of the columnar supports any convenient fashion—by stamping, forging, machining or cutting.

I claim:

1. A support system for a shelf, said support system being attached to a fixture, said support system comprising:

a plurality of normally vertical, columnar supports, each of said columnar supports having a back adapted for attachment to the fixture and at least one longitudinally-extending flange attached to the back, extending forward therefrom and terminating in a front edge, each of said flanges having a cutout formed along its length, each cutout opening into said front edge, extending rearward therefrom and being shaped so that the upper and forward part of its periphery defines a downwardly-extending upper-lip of flange material, and means for supporting said shelf, said supporting means including a linear extrusion, said extrusion being oriented normally-horizontal and fitting into a plurality of said cutouts, each extrusion having integral upper, rear and lower walls defining (in section) a forwardly-extending and forwardly-opening shelf-slot which extends along the extrusion and is thereby adapted to receive the rear edge of the shelf to be supported thereby, each of said extrusions also having an upwardly extending thumb-strip formed integrally with said upper wall of the extrusion near the forward open end of said shelf-slot and adapted for location behind said upper lip when the extrusion is placed within said cutout, whereby, the extrusion may be inserted rearwardly into one of the cutouts by first tilting the extrusion up and back to allow said thumb-strip to pass behind said upper-lip and then tilting the extrusion down and forwards until the forward face of said thumb-strip contacts the upper-lip and the lower and/or rear walls of the extrusion make contact with the periphery of the cutout.

2. A support system according to claim 1 wherein, at least the rear portion of said upper wall of the shelf-slot of each extrusion is substantially horizontal (when viewed in section and said extrusion is fitted within one of said cutouts), and the rear of the cutout is shaped to define a downwardly-facing substantially horizontal shoulder adapted to abut and support said rear portion of the upper wall, so that, when the extrusion is fitted within the cutout and a shelf is fitted within said shelf-slot, the weight of the shelf is principally supported by the columnar support via said shoulder and the lower and forward edge of the cutout.

3. A support system according to claim 1 wherein:

the lower and forward part of the periphery of said cutout defines an upwardly-extending lower-lip of flange material, and a forwardly-facing abutment is formed on or by said lower wall of the extrusion and is adapted to abut against the rear edge of said upwardly-facing lip when the extrusion is fitted within the cutout, whereby, after insertion in the cutout, the extrusion cannot be removed without first raising said abutment clear of said lower-lip.

4. A support system according to claim 3 wherein:

the cutout extends substantially below the level of the rear portion of the lower wall of the shelf-slot (when the extrusion is fitted with said cutout), so that the extrusion can be entered and removed from the cutout by tilting its rear downward so that said abutment clears said lower lip.

5. A support system according to claim 2 wherein, the forward portion of the lower wall of the shelf-slot is raised at or near its forward end relative to the rear portion thereof so as to define, on the upper face of the lower wall, a land for the support of a shelf fitted within the shelf-slot and so as to define, on the under-face of the lower wall, a recess or slot adapted to accommodate said lower lip when the extrusion is fitted within said cutout; and the forward portion of the upper wall of the shelf-slot is raised relative to the rear portion thereof so that (i) the height of the front opening of the shelf-slot (measured between said land and said forward portion of the upper wall) is substantially greater than the thickness of a shelf to be accommodated within said shelf-slot, (ii) the vertical distance between the level of the rear portion of the upper wall and level of said land approximates said thickness, and (iii) the distance between the rear portion of the upper wall and the rear portion of the lower wall is substantially greater than said thickness;

whereby a shelf of said thickness may be readily inserted within the shelf-slot by tilting the shelf up and back to pass the rear edge of the shelf rearwardly beyond the land and beneath the rear portion of the upper wall, the shelf being returned to the horizontal after insertion into the shelf-slot so that it is supported by the contact of its upper rear edge with the rear portion of the upper wall and by contact of its lower face with the land formed on the upper face of the lower wall.

6. A support system according to claim 1 wherein, an upper upwardly-facing panel-slot is formed along the forward edge of the upper wall of the shelf-slot, a lower downwardly-facing panel-slot is formed along the forward edge of the lower wall of the shelf-slot, the depth of said lower panel-slot being greater than that of said upper panel-slot, said panel-slots being adapted to respectively accommodate the lower and upper edges of panels fitted respectively between said extrusion and adjacent upper and lower extrusions arranged in respectively upper and lower cutouts in said columnar support.

7. A support system according to claim 1 wherein, said thumb-strip is of curved shape in section so as to form a forwardly facing hook adapted to be engaged with and rotate about the upper-lip as the extrusion is first entered into the cutout.

* * * * *